US005303524A

United States Patent [19]

Caspe

[11] Patent Number: 5,303,524

[45] Date of Patent: Apr. 19, 1994

[54] EARTHQUAKER PROTECTION SYSTEM AND METHOD OF INSTALLING SAME

[76] Inventor: Marc S. Caspe, 7522 Vista del Mar, Playa Del Rey, Calif. 90293

[21] Appl. No.: 848,666

[22] Filed: Mar. 9, 1992

[51] Int. Cl.[5] ..... E04H 9/02

[52] U.S. Cl. ..... 52/167 DF; 52/167 RM; 52/167 T; 248/636

[58] Field of Search ..... 52/167 R, 167 DF, 167 CB, 52/167 RM, 167 T; 248/636, 638, 580, 582; 384/36

[56] References Cited

U.S. PATENT DOCUMENTS

| | | | |
|---|---|---|---|
| 3,638,377 | 2/1972 | Caspe | 52/167 E |
| 4,238,137 | 12/1980 | Furchak et al. | 52/167 R |
| 4,278,726 | 7/1981 | Wieme | 248/638 X |
| 4,553,792 | 11/1985 | Reeve | 52/167 R |
| 4,599,834 | 7/1986 | Fujimoto et al. | 52/167 EA |
| 4,644,714 | 2/1987 | Zayas | 52/167 |
| 4,766,706 | 8/1988 | Caspe | 52/1 |
| 4,793,105 | 12/1988 | Caspe | 52/167 |
| 4,881,350 | 11/1989 | Wu | 248/580 |
| 5,014,474 | 5/1991 | Fyfe et al. | 52/167 EA |

FOREIGN PATENT DOCUMENTS

| | | | |
|---|---|---|---|
| 1513555 | 1/1968 | France | 52/167 |
| 137634 | 8/1983 | Japan | 248/638 |
| 192951 | 8/1989 | Japan | 52/167 R |
| 1149521 | 4/1969 | United Kingdom | 384/36 |

*Primary Examiner*—Carl D. Friedman
*Assistant Examiner*—Kien Nguyen

[57] ABSTRACT

A system for protecting a building or piece of equipment against the forces generated by an earthquake is characterized by one or more approximately horizontal interfaces having sliding means associated therewith which permit relative horizontal multi-directional sliding movement between the superstructure and the supporting substructure. Calibrated control means such as low-friction sliding means and/or adjustable friction clamps may be utilized to adjust the threshold horizontal force required to cause such relative movement. Biasing means such as spring members may be utilized to urge the superstructure towards its pre-earthquake alignment relative to the substructure. Other advantages are provided by substrate grid means that permits the ready adjustment of the friction force exerted by the low-friction sliding means, and by the concave configuration of the sliding interfaces. A method of installing such a system is disclosed.

29 Claims, 4 Drawing Sheets

VARIATION OF MAXIMUM SLIDING COEFFICIENT OF FRICTION WITH VELOCITY AND PRESSURE ON UNFILLED TEFLON SLIDING ON STAINLESS STEEL

EARTHQUAKER PROTECTION SYSTEM AND METHOD OF INSTALLING SAME

This specification incorporates by reference the disclosures in my earlier granted U.S. Pat. Nos. 3,638,377, 4,766,706, and 4,793,105, which patents issued Feb. 1, 1972, Aug. 30, 1988, and Dec. 27, 1988, respectively.

BACKGROUND OF THE INVENTION

This invention relates to an improved system for protecting a building, a piece of equipment, or a similar superstructure against damage or collapse due to predicted maximum earthquake vibrations. The invention provides stable and controllable performance during an earthquake, with minimum spatial requirements and minimal costs, and is useful both in the construction of new buildings or equipment installations, and when retrofitting existing structures or equipment installations to enhance their earthquake resistance.

Earthquakes present a major public safety hazard. Building occupants and persons on the streets adjacent buildings and other structures are in peril during an earthquake. In addition, earthquakes create a major economic liability for building owners and communities that depend on the continuity of building usage.

Thus, buildings and equipment, as well as people in and around such buildings and equipment, need protection against the effects of structurally damaging forces generated by the random ground movements of earthquakes. My above-identified previous patents disclose various apparatus for providing such protection. The instant invention provides an improved system for such protection, by enhancing stability and controllability as well as minimizing spatial interferences and costs.

Among other things, my U.S. Pat. No. 3,638,377 explains the bases and method for limiting the horizontal transfer of inertial forces between a superstructure and its substructure, and for calculating an anticipated horizontal displacement of that superstructure with respect to its supporting substructure. As set forth below, after that displacement has been calculated, it may be utilized to determine the dimensions required in the aforementioned minimum spatial interference. As further explained below, that calculated displacement is directly related to the "predetermined distance" discussed hereinbelow.

OBJECTS AND ADVANTAGES OF THE INVENTION

It is, therefore, an object of my invention to provide an improved system for protecting buildings, equipment and other superstructures from the damaging effects of earthquakes, and a method for installing same in both new and existing structures. The system isolates a superstructure from its substructure to prevent damage to either from horizontal inertial forces acting between them, such as forces which would be imposed by a maximum credible earthquake. In the preferred embodiment, a plurality of columns and/or walls support the superstructure's weight above the foundation; each of the columns and/or walls is respectively detached from the substructure in an approximately horizontal plane, and is then re-attached with the means disclosed in the instant invention. Those skilled in the art will understand the aforementioned "walls" to include shear walls constructed from, for example, cross-braced steel frames.

The system preferably includes sliding means adjacent the locus of the detachment. The sliding means preferably includes bearing plate means operably attached to either the superstructure or the substructure, and sliding members attached to the other of the superstructure or the substructure. The sliding members may include ball bearings, roller bearings or the like, and/or may include a layer of low-friction material such as Teflon® in confronting sliding contact with the bearing plate means.

The system further preferably includes control means for exerting a calibrated horizontal drag force in opposition to any relative horizontal movement between the superstructure and the substructure. In a preferred embodiment, the control means includes the sliding members being constituted by substrate means upon which the low-friction material is disposed. By selecting the size and number of such substrates, and by determining the size and the number, if any, of openings or cavities in the substrate, a horizontal frictional force of the low-friction material may be selected that will not cause damage in a strong-motion earthquake. With this type of control means, although the frictional force is dependent upon the building's weight, it can nevertheless be readily calculated, adjusted and calibrated to a desired percentage of that weight. A chart related to such calculations and calibration are discussed hereinbelow as FIG. 10.

The preferred control means includes a spring element such as a rubber pad adjacent each of the sliding members and operably attached thereto. These spring elements provide numerous benefits, including, for example, that it: accommodates some degree of misalignment during installation and subsequent displacement; provides a shock buffer so that shuddering of the superstructure is reduced or eliminated even when an earthquake suddenly exerts a force in the direction reverse to that in which the superstructure is sliding; and provides some accommodation of rotational motion between the superstructure and substructure during an earthquake.

The preferred control means further includes plate means extending a predetermined distance in an approximately horizontal peripheral direction from the respective column and/or wall, such distance being sufficient to accommodate the anticipated horizontal displacement of the superstructure with respect to the substructure, while maintaining the operability of the system. The configuration of the instant invention permits the overall size of the system to be substantially reduced from those of prior art systems.

Biasing means preferably acts between the superstructure and the substructure to urge the superstructure to return to its original position relative to the substructure, in response to any such relative movement between the superstructure and the substructure. As will be understood by those skilled in the art, this biasing force must be "stiff" enough to provide the desired biasing and yet "soft" enough to prevent vibratory motion (as opposed to the desired random sliding) from being transmitted from the substructure to the superstructure.

In the preferred embodiment, the control means includes clamp members acting on the extending plate means, providing an adjustable and calibrated frictional drag force against relative movement of the superstructure with respect to the substructure. Where such clamping members are utilized, the frictional drag forces can be readily adjusted and calibrated by, among other things, adjusting the clamping force. Such clamp members preferably contact the extending plate means at one or more locations which permit the plate means to move, with respect to the clamp members, horizontally in any direction a distance of at least approximately the predetermined anticipated horizontal shifting distance during a maximum credible earthquake.

It is a further object of the invention to provide a system of the aforementioned character in which the bearing plate means includes a concave portion therein. When used in combination with inflatable flat-jacks to position the plate means, the system is readily installed and aligned. A hardening slurry may be pumped into the flat-jacks and allowed to set, thereby providing permanent positioning of the plate means in the assembly without distorting the bearing surface of the plate.

It is yet another object of the invention to provide a system of the aforementioned character, in which the detachment divides the respective column or wall into a relatively longer section and a relatively shorter section, and the bearing plate means is operably attached to the relatively shorter section. This maximizes the stability of the longer section, imparting all sliding eccentricities to the shorter section because the low-friction material on the sliding members can be affixed concentrically to the relatively longer section and can move therewith across the bearing plate means during earthquake-induced movement.

Yet another object of the invention is the provision of biasing means of the aforementioned character including spring members operatively connecting or attached between the substructure and the superstructure, and further including restraint means and limitation means to increase the rate of increase of the biasing force of the spring members, in greater proportion as the displacement of the superstructure increases relative to the substructure. The means for increasing the biasing force may include, for example, additional springs that do not engage until some relative displacement has occurred, and that increase the total spring force in proportion to the relative displacement. The limitation means preferably provides a positive displacement limit on the sliding displacement of the superstructure with respect to the substructure, and is capable of exerting and transmitting forces greater than the ultimate strength of the building.

In a preferred embodiment, the spring members are substantially cylindrical with a longitudinal central axis of said cylinder aligned in a substantially vertical or horizontal direction, and the restraint means and limitation means include one or more substantially inflexible annular members. Each of the annular members is disposed about an end of one of the spring members, and each of the annular members has a central annular axis substantially aligned with the longitudinal axis of the spring member.

In addition, each of the annular members is preferably "programmable", in that its internal annular cross-section can affect the performance of the biasing means. For example, a curvilinear internal annular contact surface may be defined by the internal diameter of the annular member gradually increasing with distance along the central annular axis from the end of the spring member. Thus, as the relative displacement of the superstructure on the substructure increases, more of the cylindrical spring member contacts the inner surface of the annular member, causing a corresponding "stiffening" of the spring member by reducing the effective flexible length of the spring member.

The biasing means is preferably of such low stiffness relative to the sliding means that the combined biasing force and sliding friction force prevents any damaging vibratory magnification effects from passing from the substructure to the superstructure, and instead has sufficient damping relative to the biasing means spring stiffness that vibratory motion cannot occur, thereby providing random durations of sliding motion between the substructure and the superstructure.

Alternative embodiments of the biasing springs would include, by way of example: attaching spring members between new or existing portions of the superstructure/substructure; providing an auxiliary frame adjacent the sliding locus, with spring members attached between the frame and the superstructure/substructure (useful, for example, when the superstructure/substructure is too weak to resist the various forces). If appropriately designed, such an auxiliary frame itself can incorporate the desired "spring" action, thus eliminating the need for additional spring members.

A further object of the invention is the provision of a more compact and less costly apparatus for providing controlled horizontal movement of a superstructure with respect to its substructure during an earthquake at a joint or interface therebetween, which apparatus is characterized by control means including plate means disposed approximately horizontally through the joint or interface and operably attached to either the superstructure or the substructure. The plate means preferably extends a predetermined distance in an approximately horizontal peripheral direction from the superstructure or the substructure to which the plate means is attached. Sliding means is disposed between the plate means and the other of the superstructure or the substructure to permit relative horizontal movement between the superstructure and the substructure when horizontal forces are imposed on the substructure, such as those which accompany an earthquake. Biasing means acts between the superstructure and the substructure to urge the superstructure towards its original position relative to the substructure in response to any such relative movement between the superstructure and the substructure.

An additional object of the invention is the provision of an earthquake protection system of the aforementioned character which imparts four "earthquake barriers":

1. a "force barrier" that limits horizontal base shear forces to less than the minimum threshold force required to damage the structure. This force barrier provides a high safety factor against damage or collapse of the structure;
2. an "energy barrier" that dissipates an earthquake's energy by frictional heat transfer that occurs either at clamping plates located adjacent to the supporting members of the structure or at weight-supporting plates below said members, instead of the dissipation of energy commonly employed by permitting the earthquake to inelastically stretch and damage walls, columns and girders in the superstructure, consequently deforming or collapsing the walls, columns and girders inelastically and causing a hysteretic heat energy transfer by them;
3. a "vibration barrier" that prevents resonant frequencies of the earthquake ground motion from magnifying the damage to the building by tuning-in on the natural frequencies of the building. This is achieved by creating a horizontal sliding motion that has random durations in random directions and hence no vibratory frequency because the system is near critical damping; and 4. a "displacement barrier" which, in the event of any relative horizontal movement between the superstructure and the substructure, biases the superstructure toward its initial alignment atop the substructure during any further duration of sliding motion.

It is yet another object of the invention to provide a method for installing an earthquake protection system in an existing building having columns and/or walls that support the superstructure on the substructure of the building. The preferred method is characterized by the steps of: pre-testing the vertical loads on the columns and/or walls by temporarily supporting the vertical load imposed on a column or wall with a framework or other support means, whereby that actual load information may be utilized instead of mere calculated loads in connection with designing the system; removing an approximately horizontal section of the column or wall by cutting, coring or other appropriate means; designing and/or fabricating sliding apparatus on the basis of the pre-tested vertical loads; and inserting the sliding apparatus (including an appropriately designed substrate, where substrate means are utilized) into the just-vacated horizontal section of the column or wall to permit horizontal movement of the superstructure relative to the substructure whenever the calibrated horizontal forces occur, as desired to protect the building against damage. The method further preferably utilizes apparatus which includes one or more flat-jacks and rubber or elastomeric pads, or similarly pressurizable means for adjusting the position and loading of the bearing plate means relative to the horizontal plane, and includes the steps of separately adjusting the pressure in each flat-jack or similar means for appropriate alignment and bearing forces, before grouting the bearing plate in place and removing the temporary framework or other support means.

The preferred method of the invention further includes the step of pumping a cement or epoxy slurry mixture into the flat-jacks or similar means and permitting the mixture to permanently solidify, as indicated above. The preferred method thereby provides a direct bearing transfer (as opposed to flexural transfer) of the compressive stress through the sliding assembly and prevents significant flexural distortion of the sliding means, such as the bearing plate surface. Thus, the invention provides a method for readily obtaining the safety and economic benefits of the system in retrofitting existing structures, or by using similar techniques and configurations in new structures.

Another object of the invention is to provide a method of the aforementioned character, in which the superstructure is separated from the substructure by coring (drilling a series of adjacent holes) slots in the walls and/or columns. This coring method, especially as compared to saw cutting, provides a scalloped surface which permits a mechanical locking between the eventually-hardened grout and the superstructure or substructure.

At walls, the slots help avoid the need for the temporary supports that are required when a column is cut. All slots can instead be spaced apart so that the wall "arches" over each slot, permitting the slide assembly to be installed and thereafter pressurized with flat jacks (described hereinbelow). After such pressurization, the severance of the wall is completed by removing the portions between the slots.

Additionally, the aforementioned temporary support or framework may be further utilized "permanently" as an auxiliary brace for the building, and/or for mounting biasing and/or limit-stop spring members.

The preferred sequence for fabricating and assembling the preferred sliding means includes the steps of vulcanizing or otherwise bonding the steel and rubber member, coating the teflon onto a steel backing plate (including any substrate), and tackwelding these assemblies together in their desired relationship on-site. This sequence permits the necessary vulcanization and coating to be accomplished efficiently and cost-effectively, such as in locations dedicated to those processes. Moreover, the system is thereby extremely versatile, in that any of those components can be readily replaced in order to modify its calibrated friction characteristics, by simply jacking up the particular joint and melting the tackweld (thereby freeing the individual components to be removed/replaced).

Other objects and advantages of the invention will be apparent from the following specification and the accompanying drawings, which are for the purpose of illustration only.

DESCRIPTION OF PREFERRED EMBODIMENT

Figure 1:
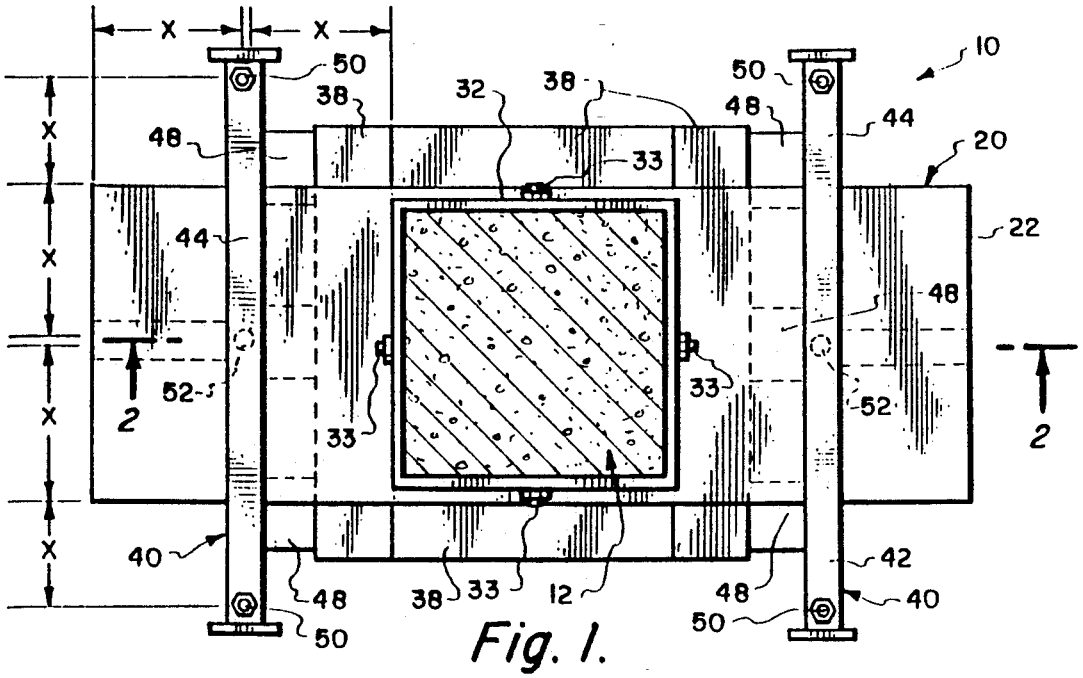
FIG. 1 is a partially-sectional plan view of a preferred embodiment of an earthquake protection system constructed and assembled in accordance with the teachings of my invention.
Figure 2:
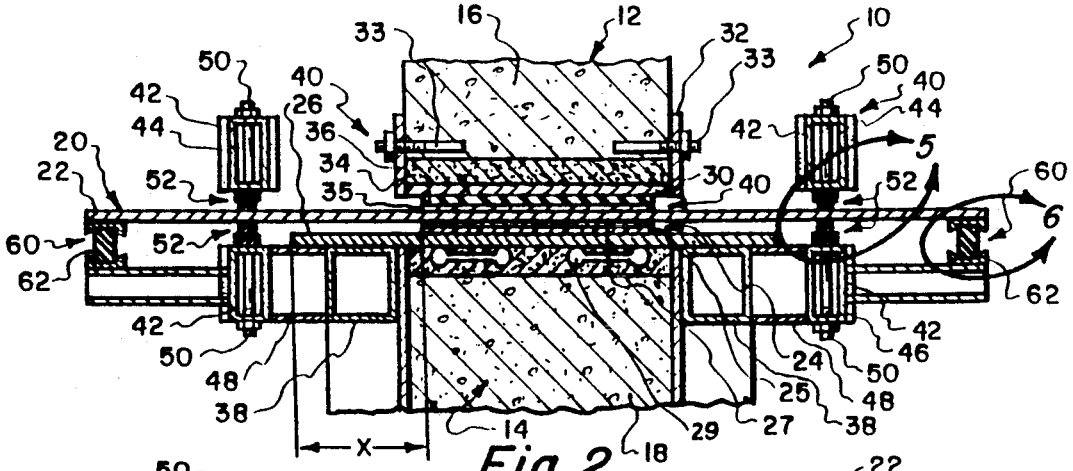
FIG. 2 is a sectional elevation view, taken along line 2—2 of FIG. 1.

Referring to the drawings, and particularly to FIGS. 1 and 2 thereof, I show apparatus assembled to form a joint or system 10 constructed and assembled in accordance with the teachings of my invention, which permits the relative horizontal movement of a superstructure 12 with relationship to a supporting substructure 14. For purposes of illustration, the attached drawings disclose the superstructure 12 and the substructure 14 as upper and lower portions 16 and 18, respectively, of a column or wall; those skilled in the art will understand, however, that the portions 16 and 18 are for purposes of illustration only and that the teachings of the invention may be readily applied to wall-type supports, permanently-mounted equipment, and similar structures such as the abutment of bridges.

The vertical loads of the building or superstructure are supported during normal (i.e., non-earthquake) use of the superstructure by the vertical alignment of the superstructure or upper column portion 16 over the corresponding supporting lower or substructure portion 18. Those skilled in the art will understand that in many applications (such as, for example, the building illustrated in FIGS. 1-4 of my previous U.S. Pat. No. 3,638,377) an array or multiplicity of horizontal sliding joints or interfaces 10 or similar apparatus will be employed, one at each connection of the superstructure to the substructure, so that the superstructure is effectively severed or detached from the substructure. This detachment permits the desired horizontal sliding movement between the superstructure and the substructure during earthquakes.

In the preferred embodiment as utilized for columns in a building, the detachment of the superstructure 16 from the substructure 18 occurs either just above the building's foundation footings and just below the basement floor, or just below the first floor of the building; the detachment can, however, be located in any story of a building. In any case, the column (or wall, as those skilled in the art will understand) is preferably effectively divided into a relatively longer portion and a relatively shorter portion.

During an earthquake, the shorter and longer portions will tend to "slide" horizontally relative to one another. Because the longer portion preferably includes a disposition of low-friction material 25 (as more thoroughly described below) affixed concentrically about its centerline, the eccentricity occasioned by this sliding is wholly resisted by the shorter and more stable portion, preventing eccentric loading conditions from occurring in the longer, more vulnerable portion, during conditions of extreme relative horizontal displacement. The supporting surface about the shorter arm portion can be enlarged to accommodate such eccentric loading conditions (as more fully described hereinbelow), whereas enlargement of the supporting surface about the longer arm portion could functionally interfere with use of the building and could increase the cost of the joint 10, as well as make the assembly thereof substantially more difficult. Accordingly, in the preferred embodiment, the low-friction material 25 is affixed to the relatively longer portion or arm, illustrated in FIG. 2 as superstructure portion 16.

Those skilled in the art will understand, and as more fully explained herein, that the embodiment of FIG. 2 illustrates the installation of the system at the bottom of a column or wall. By turning the assembly upside-down, similar to the installation illustrated in FIG. 7, the system may be readily utilized at the top of a column or wall.

The preferred embodiment of FIG. 2 includes sliding means 24 disposed between the superstructure and substructure. The sliding means 24 permits the aforementioned desired horizontal movement of the substructure 14 with respect to the superstructure 12.

The sliding means 24 preferably includes bearing plate means 26 attached to either the superstructure or substructure (and, as indicated above, to whichever of the superstructure or substructure is the "shorter portion").

In the preferred embodiment, the sliding means 24 also includes a layer, coating, film or other disposition 25 of low-friction elastomeric material such as tetrafluoroethylene or Teflon®, in a confronting, slideable relationship with the bearing plate means 26, whose confronting contact surface is of polished stainless steel or other suitably smooth finish. For ease of manufacture and assembly, as more thoroughly discussed elsewhere herein, the coating 25 is preferably mechanically and chemically bonded to a metal plate 27 by pressing or like expedient. When the joint 10 is being assembled, the plate 27 can be appropriately positioned and then affixed to the plate member 22 (discussed below), by tack-welding or the like.

Figure 3:
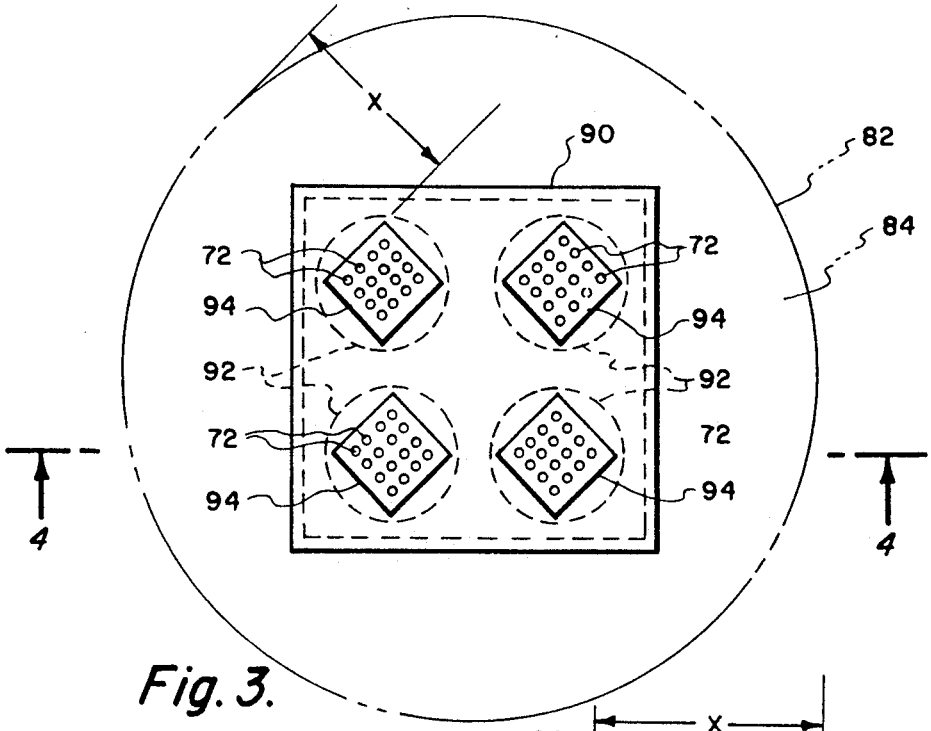
FIG. 3 is a partially-sectional plan view of an alternative embodiment of sliding means constructed and assembled in accordance with the teachings of the invention.
Figure 4:
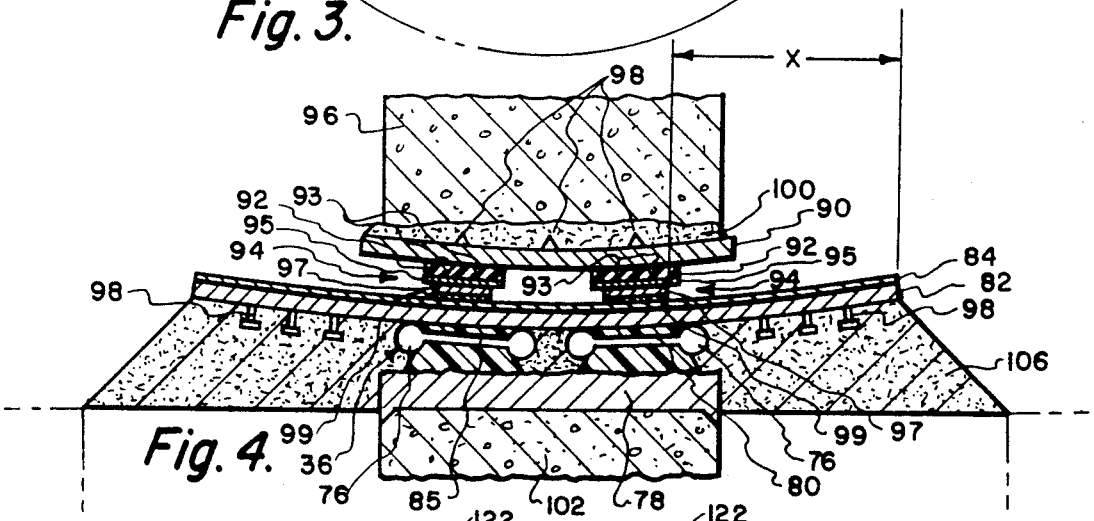
FIG. 4 is a sectional elevation view, taken along line 4—4 of FIG. 3, illustrating a concavity in the bearing plate means and the use of the invention near the bottom of a column or wall.

For the sake of clarity, it is convenient to identify elements in the embodiment of FIGS. 3 and 4 that correspond to elements in the embodiment shown in FIGS. 1 and 2:

| | FIGS. 1-2 | FIGS. 3-4 |
|---|---|---|
| Middle Plate | 20 | 95 |
| Teflon | 25 | 99 |
| Stainless | 26 | 82, 84 |
| Substrate | 27 | 97 |
| Jacks | 29 | 76 |
| Top Plate | 30 | 90 |
| Rubber | 34 | 92 |
| Assembly | 24 | 94 |

For the most part, although differently configured, these various components perform comparable functions in each of the illustrated embodiments.

Although the preferred embodiment illustrates a "one-piece" elastomeric coating and backing plate 25 and 27, an alternative embodiment of the sliding means 24 is illustrated in FIGS. 3 and 4, and includes a "multi-piece" coating, film or other disposition of low-friction elastomeric material in the form of elastomeric pads 99 and backing plates 97. Both the "one-piece" and the "multi-piece" constructions can be utilized as part of the control means 40, as more thoroughly discussed below.

The pads 24 (FIG. 2) and 94 (FIG. 4) preferably include substrate means such as substrates 27 and 97 fabricated from a suitably hard material such as mild steel or stainless steel. One side of the substrate is operatively affixed to a plate 90 (which is in turn affixed to the superstructure, as described in further detail below), and the other side of the substrate is coated with a layer 99 of the low-friction material which corresponds to the layer 25 of FIG. 2.

Among other things, the pads 24 and 94 may be utilized as control means 40 to "fine-tune" or customize the dynamic sliding characteristics of the system 10 for any particular application. Such customization may be accomplished, for example, by selecting the size and/or number of the pads 24 or 94, and/or by drilling holes, forming cavities or providing indentations 72 therein, as shown in FIG. 3. As those skilled in the art will appreciate, such provision of holes or cavities 72 directly affects the vertical contact area and corresponding pressure under the vertical weight of the superstructure 16, thereby affecting the horizontal friction force between the superstructure 16 and the substructure 18; in other words, the cavities 72 affect the area upon which the vertical load or weight of the superstructure 16 is imposed. No weight is transferred at the locations of the holes 72, and thus more weight must be transferred across the areas between the holes 72, thereby increasing the pressure in those areas and altering the frictional drag force created by those areas of the substrate means, as illustrated on the chart of FIG. 10. Thus, the desired horizontal frictional drag force may be calibrated for any given application and the substrates 97 or 25 can be readily modified and adjusted to achieve same.

As indicated above, the effective area supporting the vertical load of the superstructure may be varied by selecting the overall bearing area of the substrate 25 or substrates 97. Such an adjustment may be made instead of and/or in addition to providing holes 72, with similar and/or cumulative effect on the vertical pressure and corresponding horizontal frictional force. In order to permit the substrate to distribute the vertical weight load more evenly across the other portions of the joint 10 and the adjacent portions of the building and thereby reduce the likelihood of damage to those other elements, however, the use of holes 72 is preferred over excessively reducing the size of the substrates. The use of the cavities 72 not only reduces the contact area for purposes of adjusting vertical pressure and horizontal frictional forces, but it also maintains the desired pressure distribution of the vertical weight load across the adjacent concrete 96 and rubber member 92 (more thoroughly described below).

In alternative embodiments, the layer 99 of the low-friction material may be affixed directly to the plate 90, FIG. 4, in which case the intervening components of FIG. 4 would be omitted. In such a construction, the effect of the holes 72 can be achieved by providing indentations on or cavities in the lower surface of the plate 90 prior to applying the layer 99 of the low-friction material.

In the assembly of the system 10, the low-friction material 27 is in confronting contact with a slidingly mating surface of a plate member 26. Those skilled in the art will understand that an appropriate slidingly mating surface must be provided on the plate means 26 to ensure optimum performance of the tetrafluoroethylene or other sliding means 24. For example, the plate means 26 may be fabricated from solid stainless steel, may have a nickel-hardened surface, or may have a stainless steel veneer in confronting contact with the sliding means 24.

Those skilled in the art will also understand that the low-friction elastomeric material could alternatively be affixed to the upper surface of the substructure 14, with equal efficacy except for possible additional materials and cost considerations set forth above. For example, sliding means 124, FIG. 7, are disposed on the upper end of a lower portion 120, as explained below.

Alternative sliding means 24 include, by way of example and not by way of limitation, ceramics, metals, elastomers, G-12 ®, ball bearings or roller bearings. Where indicated, arrays or multiple layer of such bearings (for example, two orthogonal layers of roller bearings) may be utilized to provide the desired low-friction sliding function.

Figure 7:
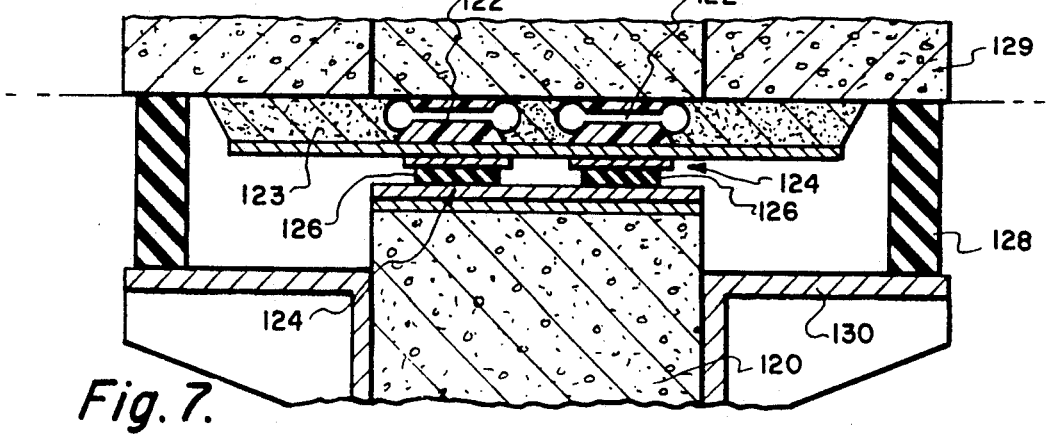
FIG. 7 is a sectional elevation view of an alternative embodiment of the invention, illustrating its use in an inverted configuration near the upper end of a column or wall.

To aid in the installation and alignment of the various components of the system 10, and especially when retrofitting existing buildings, the preferred embodiment also includes installation adjustment means 36 such as flat-jacks 29, 76 and/or 122, FIGS. 2, 4 and 7, respectively. Referring to FIG. 4, these flat-jacks are preferably positioned in direct vertical alignment with the substrates 94 and are disposed on the opposite side of the metal plate 82 from the substrates 94. The metal plate 82 corresponds to the metal plate 26 in FIG. 2, as more fully explained elsewhere herein; those skilled in the art will therefore understand that one or more flat-jacks could be readily utilized in the embodiment of FIG. 1 as well, such as by being disposed beneath the plate 26.

The flat-jacks 76, FIG. 4, can be pressurized to expand and bring the low friction material 99 into the desired confronting, weight-bearing contact with the slidingly mating surface of the plate member 82, as more thoroughly discussed below. This permits an ease of installation which would not otherwise be available, especially in retrofit applications, by allowing the plate 82 to be located with less levelling precision than would otherwise be necessary. In other words, a degree of imprecision in the levelling of the plate 82 can be accommodated by the expansion of the flat-jacks 76, thereby compressing the rubber pads 92 in a manner to reestablish the horizontal alignment of the plate 82, while ensuring that the vertical loads from the superstructure are passed directly through the relevant plates of the system 10 without distorting the shape of those plates.

The flat-jacks may, of course, be utilized on either or both sides of the joint 10, but a rubber compressible element such as pads 92 are needed on the side of the joint opposite any such flat-jack; in the embodiment of FIG. 4, for example, flat-jacks could be positioned behind the plate 90 before the placement of the grout 100 therebehind, more fully described below.

As those skilled in the art will understand, preferred flat-jacks such as those available from Freysi Corporation are of the type that may be pressurized with water or a similar liquid. As set forth in more detail below, after the flat-jacks are appropriately positioned and shimmed with epoxy mortar and/or metal shims, they are pressurized with a slurry of cement, epoxy mortar or similar mixture that is pumped into the flat-jacks, displacing the water. When the mixture subsequently hardens inside the flat-jacks, both the flat-jacks and the hardened mixture therein become a permanent element for vertical load-bearing in the system 10, which element is unaffected by the mere puncture or degradation of the flat-jack body or covering material itself.

As indicated above, the preferred embodiment of the joint 10 includes control means 40. As set forth above, the control means 40 may include the provision of substrates 97 and/or the use of holes 72 therein. Control means 40 may also or alternatively include plate means 20. Plate means 20 is preferably a substantially planar metal or structural steel plate 22, fabricated either of polished stainless steel or of a mild steel that is faced with a stainless steel veneer. Plate means 20 preferably extends through the locus of the detachment of the superstructure from the substructure so that it is disposed between the upper portion 16 and the lower portion 18 of the column or wall. Plate means 20 further preferably is oriented in an approximately horizontal plane and extends a predetermined horizontal peripheral distance from the column or wall. In the preferred embodiment, a stainless steel veneer or surface is provided on both sides of the plate 22, for purposes that will become apparent in the following description.

Plate means 20 is operably attached to either the superstructure 16 or the substructure 18. In the preferred embodiment of FIG. 2, the attachment of the plate 22 to the upper portion 16 of the column or wall includes a metal plate member 30 which is affixed to the upper portion 16 through the use of known expedients, such as grouting, epoxying, mechanical bonding, etc. Shear spring means such as a thin layer 34 of compressible rubber is preferably sandwiched between the plate member 30 and plate means 20, and is affixed to both plates 30 and 20.

This affixation may be accomplished directly through the use of an appropriate adhesive such as vulcanizing, epoxy or the like (such as the affixation illustrated on the upper surface of the rubber member 34), or may involve an additional metal backing plate 35 (such as illustrated on the lower surface of the rubber member 34). Such a plate 35 is beneficial for purposes of manufacturing and assembly of the joint 10, in that it permits the rubber 34 to be vulcanized or otherwise mechanically bonded to the plate 35 by one specialist, and the plate 35 to then be affixed to the plate member 22 by tack-welding or similar expedient by another specialist. This separation of special ties is, of course, not necessary, but is preferred because of the benefits of time- and cost-effectiveness provided by such specialization.

Among other things, the compressible rubber layer 34 serves as another component of the aforementioned installation adjustment means 36 which may be selected and/or combined with other such components to enable easy field adjustment for installation of the system 10, especially during retrofits of existing structures, as indicated above. The rubber layer 34 also acts as a shear spring to absorb and/or lessen the initial impact or subsequent reversal of horizontal earthquake forces, thereby further cushioning the superstructure from the impact of such forces.

The metal bearing plate 26 affixed to the substructure 14 preferably extends horizontally in all directions beyond the edges of the substructure 14, to ensure that the anticipated horizontal displacement can occur without disengagement of the sliding members and bearing plates, when the superstructure 12 moves horizontally with respect to the substructure 14. The edges of the plate 26 preferably have a smooth, long-radius finished curve, so that the confronting teflon-coated surface or other sliding means will not be damaged by a sharp edge if the displacement is greater than anticipated (or if an alternative configuration, such as discussed below, is utilized in which the teflon-coated members are intended to be temporarily displaced out of engagement with the bearing plate).

Thus, the dimension of this extension preferably approaches the anticipated horizontal displacement of the superstructure 12 with respect to the substructure 14, which may be calculated as set forth in my U.S. Pat. No. 3,638,377, and which could include an appropriate safety factor. For purposes of illustration, the anticipated horizontal displacement of the superstructure is indicated as the dimension X, FIG. 1 and 2. Preferably, the dimension X is calculated using a safety factor multiplied by the maximum displacement induced into the building as calculated by a mathematical model using three or more different maximum credible earthquakes anticipated to possibly recur at the building site every 2500 years, plus or minus the distance needed to engage a fail-safe spring or bumper that begins to increase the base shear spring force during an emergency when excessive displacement occurs (as more fully described elsewhere herein).

Figure 10:
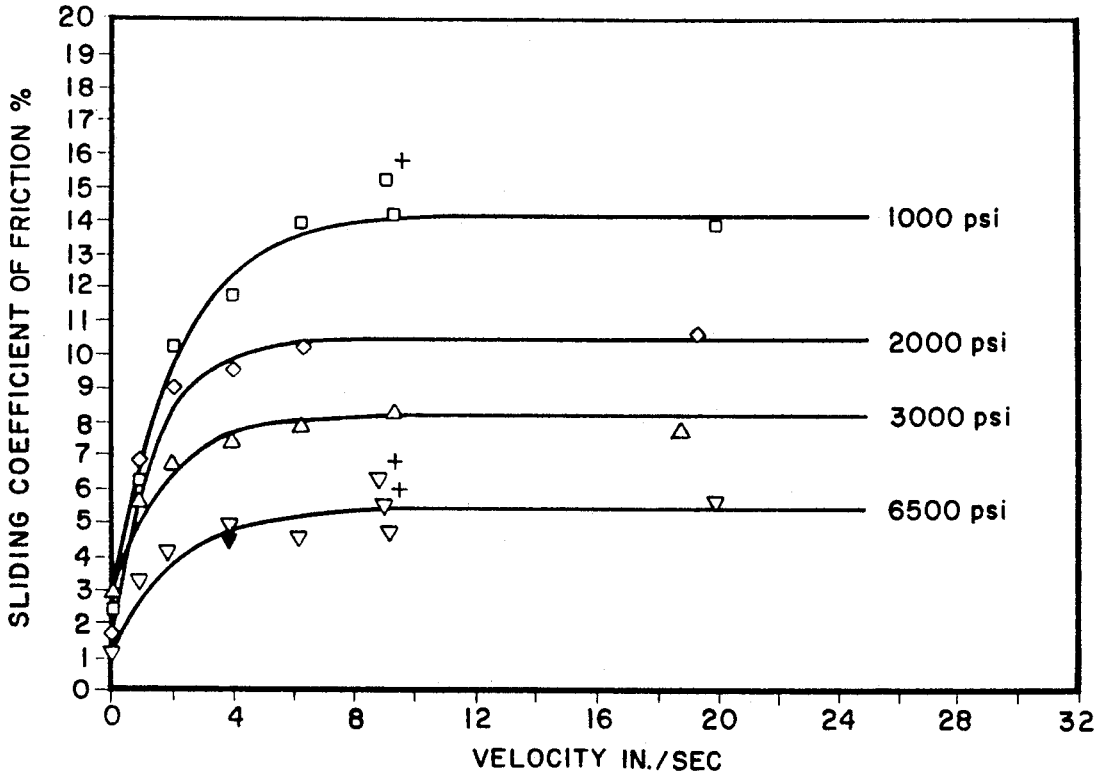
FIG. 10 is a chart illustrating the variation of maximum sliding coefficient of friction with pressure and velocity, for a preferred sliding means for controlling and predicting forces in the invention.

Also useful in connection with the aforementioned calculation and design of the system 10 are charts similar to FIG. 10, as more fully discussed elsewhere herein.

To support and transmit the vertical loads from the superstructure to the substructure while the upper portion 16 is misaligned with the lower portion 18, such as during an earthquake, the plate 26 extends by a dimension X beyond the peripherally outer edge of the aforementioned low-friction material 25, and is preferably supported by tubular metal members 38 affixed to the substructure 18. Alternatively, the substructure support could be enlarged by, for example, the provision of additional hardened reinforced concrete in place of the tubular members 38.

Alternative embodiments, not shown, would include the reduction in size, or elimination, of some portion of the peripheral support 38 or the like. By limiting the peripheral extension of such support, these alternative embodiments would reduce the risk of eccentric vertical loading during horizontal misalignment of the superstructure on the substructure, because the most extremely displaced area of the superstructure's sliding members would not be able to transmit a vertical load to the substructure.

In the preferred embodiment of FIG. 1, plate means 20 extends horizontally from the upper column portion 16 in two directions (to the right and left as the viewer looks at FIG. 1), although other embodiments could include extensions in orthogonal directions. Extensions in a plurality of directions provide greater ability to control and "fine-tune" the movement of the superstructure relative to the substructure during an earthquake without collision or disengagement of the various components of the joint system 10. Among other things, these extensions enable the use of the aforementioned control means and biasing means, described hereinbelow, and a plurality of such extensions reduce the likelihood of rotation of the superstructure about a vertical axis relative to the substructure.

Those skilled in the art will understand that the extension of plate member 22 may be accomplished by the operable assembly of two or more plates at their edges or otherwise to form the plate member 22 or may simply consist of a single contiguous plate 22, and that the teachings of the invention may be utilized with efficacy with extensions in four orthogonal directions, or indeed with any number of extensions in virtually any horizontal direction.

The preferred horizontal extension of plate means 20 away from the periphery of upper column portion 16 is slightly more than twice X. The preferred horizontal width of the extension of plate member 22 is similarly slightly more than twice X. In other words, and as more fully explained below, the preferred embodiment includes a friction contact means 52 which has an uninterrupted horizontal sliding clearance of X in all directions.

Alternative embodiments include, for example, application of the invention to a bridge abutment. Because the abutment precludes the shifting of the bridge in at least one direction (e.g., longitudinally), the clamp means can be "unidirectional" and can be configured and sized with "unidirectional" dimensions X as parameters.

Figure 5:
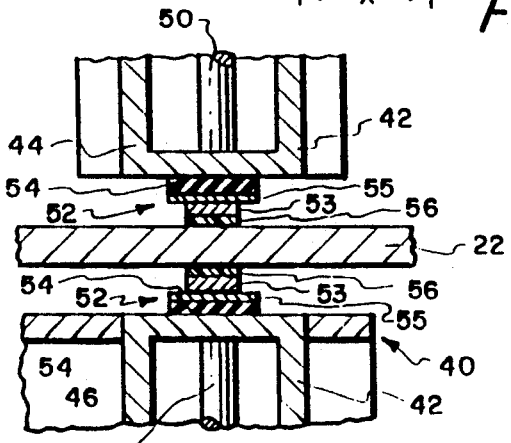
FIG. 5 is an enlarged, fragmentary sectional view of a preferred embodiment of friction clamp control means constructed in accordance with the teachings of the invention, taken along line 5—5 of FIG. 2.

These dimensions permit the utilization of additional or alternative control means 40 such as high-friction clamp or damper members 42, FIGS. 1 and 5, and ensures that the clamp members 42 will remain in operable engagement with the plate means 20 but not collide with the upper column or wall 16 during the aforementioned anticipated horizontal displacement of the substructure relative to the superstructure. As discussed elsewhere herein, the dimension X is in excess of the anticipated horizontal displacement to include a safety factor as well as the width of the contact area between control means 40 and plate means 20, described hereinbelow.

As set forth herein, the friction damper 42 can automatically transfer acceleration (i.e., pulling forces) or deceleration forces (i.e., braking forces) to the superstructure by exerting a calibrated and predetermined horizontal frictional drag force against the top and/or bottom sides of the plate member 22. Whether the force is an acceleration or a deceleration at any instant of time is, of course, dependent on the direction of the relative velocity of the substructure with respect to the superstructure at that instant in time.

In the embodiment of FIGS. 1, 2 and 5, clamp members 42 include short structural tubes 44 and 46 operatively attached to the substructure portion 18 by weldments or brackets 48 or similar expedients. Those skilled in the art will understand that, by inverting the entire joint assembly 10, the tubes 44 and 46 could alternatively be operatively connected to the superstructure portion. The tubes 44 and 46 straddle the plate member 22, and include adjustable control bolts 50 at a clear distance X from the edge of the plate member 22. The tubes 44 and 46 are characterized by high flexural and torsional strength and stiffness, which permits them to exert a compressive force toward the plate member 22 without significant distortion or twisting.

Each of the tubes 44 and 46 preferably has attached thereto contact means 52 such as a circular Teflon® pad (or other elastomer such as G-12 ® or metals such as bronze) to provide contact between control means 40 and plate means 20. The aforementioned dimensions of the extensions of plate member 22 thus are understood to ensure against disengagement of the contact means 52 from plate means 20 during an earthquake. Likewise, the dimensional clearances 21 between the control bolts 50 and the edge of the extensions of plate member 22 are understood to permit the desired sliding of the superstructure 12 relative to the substructure 14 during an earthquake without collision; less dimensional clearances would result in undesirable colliding contact between the bolts 50 and the edge of the extensions of plate member 22 during a maximum relative movement.

The control means 40, through the selection of contact means 52 and the tightening or loosening of bolts 50, provides a resistance to horizontal movement of the superstructure 16 relative to the substructure 18. In a preferred embodiment, this optional and calibrated resistance is additive to that of the sliding means 24. Because the force normal to the surface of plate member 22 is typically much greater as exerted by the weight of the superstructure than as exerted by the clamp members 42, in order to achieve the preferred relative frictional horizontal resistance between those two locations, a material having a much higher coefficient of friction is preferred for the contact means 52 than for the sliding means 24.

The provision of one or more rubber pads 54 in the contact means 52, FIG. 5, affixed to the tubes 44 and 46 to bear against both the upper and lower surfaces of the plate member 22, provides a vertical stiffness in the clamp member assembly 42 which is low enough to prevent relaxation of the bearing pressure due to creep of the preloading metals over time. This ensures that any creep in the steel bolts and/or tubes 44 and 46 results in a negligible relaxation of the bearing pressure exerted by the compressed rubber pad 54. Where the rubber pad 54 is cylindrical, creep of the cylinder can also be limited by installing thin metal straps around the rubber cylinder or by imbedding thin metal sheets within the cylinder (not shown).

Further preferred details of the embodiment of FIG. 5 (and similar to the details described elsewhere herein in relation to FIG. 4) include Teflon® pads 56 bonded to metal backup plates 53, and metal backup plates 55 vulcanized to the rubber pads 54. The metal plates 55 and 53 are affixed to one another in pairs, such as by tack-welding.

Alternative embodiments of the apparatus of FIG. 1 include, for example, the utilization of additional clamp members such as members 42 positioned on the aforementioned (but not shown) additional extensions of plate member 22. Moreover, those skilled in the art will understand that the orientation of the extensions of plate member 22 away from the column 16, 18, and the corresponding position of the clamp members 42 with respect to the column 16, 18, can be other that the illustrated orthogonal orientation. In fact, the extensions can be effectively utilized in any orientation, so long as the plate member 22 is maintained in a substantially horizontal plane. In certain orientations, it may be useful to attach the clamp members 42 to the substructure through the use of metal thrust blocks attached to the concrete footings, or similar expedient.

Figure 6:
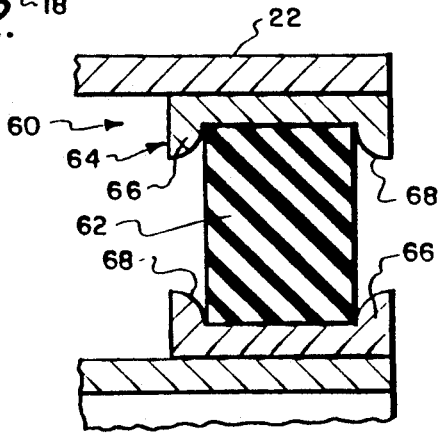
FIG. 6 is an enlarged, fragmentary sectional view of a preferred embodiment of biasing means constructed in accordance with the teachings of the invention, taken along line 6—6 of FIG. 2.
Figure 9:
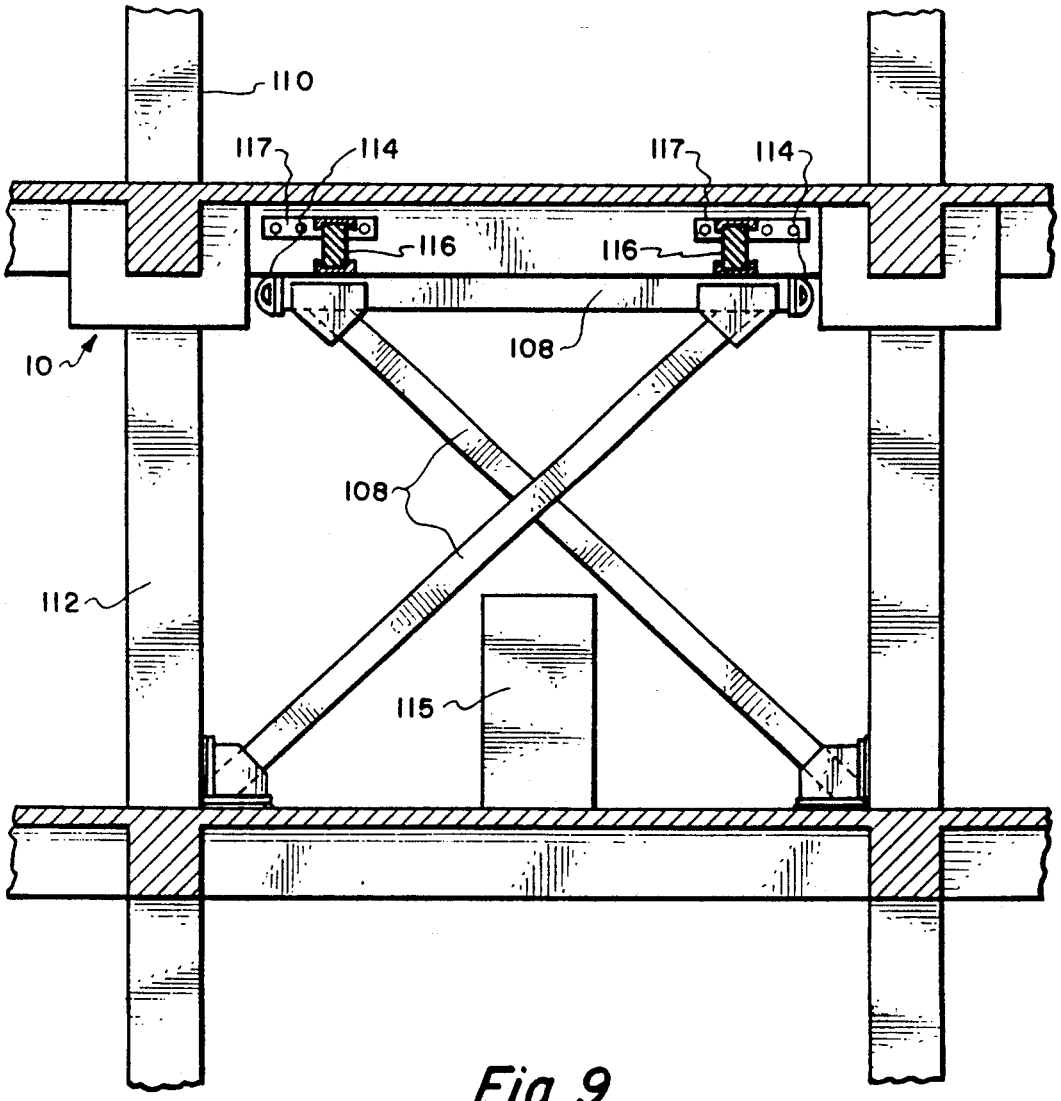
FIG. 9 is an elevational, sectional view of an alternative embodiment of the biasing means and limit-stop means of the invention.

The preferred embodiment of the joint or system 10 also includes biasing means 60, FIGS. 2, 6 and 9, which, while the superstructure 16 is displaced from the substructure 18, continually exerts a force on the superstructure to return it to its original alignment relative to the substructure. The biasing means 60 is preferably a soft spring such as cylindrical rubber or helically-coiled steel spring member 62 affixed to the superstructure 16 at one end and to the substructure 18 at the other (through a structural linkage, if necessary, such as shown in FIG. 2). The spring member 62 may, of course, be fabricated from any of a wide variety of materials and in a number of configurations, both horizontal and/or vertical, including helically coiled steel or circularly coiled wire rope springs.

The preferred biasing means 60 provides a horizontal multi-directional bias that is either applied directly by a single vertical spring or is applied vectorially by two orthogonal springs; that is, regardless of which direction the horizontal displacement occurs, the biasing means 60 exerts a returning force. The selection of a single direct acting spring or a plurality of orthogonal springs is dependent, for example, on the strength of connecting members in each direction, such as columns that could be equally strong in both directions or walls that are sufficiently strong in only one orthogonal direction.

Because the preferred biasing means is a "soft" spring, it has little or no capability of overcoming the joint 10 friction damper or friction clamp member 42 in a static condition. Nevertheless, physical tests and mathematical models have shown it effective in achieving desired results; that is, it effectively enhances the tendency of superstructures to recenter themselves over their substructures during the continuing earthquake vibrations.

The biasing means 60 preferably has a low horizontal stiffness characteristic, relative to the sliding means which makes the system recenter. Hence, the biasing means is not stiff enough to transmit vibratory or harmonic motion from the substructure to the superstructure. In this regard, the sliding means provides near-critical damping when motion is imparted by earthquakes. Such damping may be readily calculated from known mathematical models using time-history analyses.

The preferred embodiment of the system 10 further includes restraint means and limitation means 64 such as substantially inflexible annular members 66. These annular members are disposed about one or both ends of the spring members 62 and provide a programmed level of biasing force increase, relative to the horizontal displacement of the superstructure with respect to the substructure.

Figure 8:
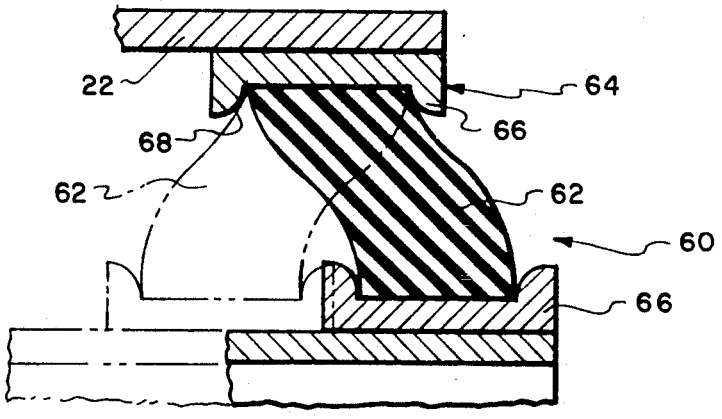
FIG. 8 is a sectional view similar of the biasing means of FIG. 6, but shown as it might appear during the displacement caused by an earthquake.

Each of the annular members 66 has a central annular axis disposed in a substantially vertical direction and a curvilinear annular cross-section 68 described by the internal diameter of the annular member gradually increasing with distance along the central annular axis from the end of the spring member. This cross-section may be modified as desired to provide the aforementioned programmed biasing force, which results from the spring member 62 gradually engaging the annular members along the surfaces 68 (during displacement such as illustrated in FIG. 8), thereby continually shortening and stiffening the spring member 62 as horizontal displacement increases. The biasing force of the spring members is eventually maximized when those members contact the full surface 68 of the annular members 66.

An alternative embodiment of the restraint means and limitation means 64 includes rigid or flexible cross-bracing 108, FIG. 9, fabricated from steel girders or the like, and operably disposed between the superstructure 110 and the substructure 112. In the embodiment of FIG. 9, the sliding means and related plate components of the system 10 are shown as being located just beneath the second floor of the structure. In other words, in FIG. 9, the superstructure 110 is severed from the substructure 112 just below the second floor.

The embodiment of FIG. 9 further includes biasing spring members 114 and 116, operatively attached to the sides and/or the top of the cross-bracing 108, which is in turn affixed to the substructure 112 so that, when the above-described relative horizontal movement occurs, one or more of the spring members engages a corresponding portion of the superstructure 110 and exerts a biasing force, urging the superstructure towards its original alignment over the substructure.

As those skilled in the art will understand, the spring members 114 and 116 may be fabricated from rubber or metal, or any suitable material. The biasing force preferably increases as the springs 114 and 116 are compressed, with a fail-safe limit stop on the relative displacement engaging at a designed displacement. In the embodiment of FIG. 9, a bracket 117 is operatively attached to the superstructure (by bolts or similar expedient), and one or more springs 116 are attached between the bracket 117 and the frame 108. The springs 116 function as the abovedescribed "soft" biasing spring, and the "stiffer" springs 114 on the ends of the frame 108 function as the limit-stop springs.

Moreover, although the embodiment of the springs 116 in FIG. 10 includes restraint and limitation means similar to means 64 of FIG. 6, that restraint and limitation means is not required when the spring elements 114 are utilized.

Additionally, the cross-bracing frame 108 can be designed with flexural members, which members become the stiffer limit-stop spring. In such an embodiment, the function of the springs 114 are provided by the frame itself, and the springs 114 can be omitted.

During retrofit construction, the cross-bracing 108 can be used to temporarily stabilize the existing building against earthquake and wind forces by temporarily attaching a short steel strut or other rigid metal member (not shown) between the frame 108 and the superstructure.

For aesthetic and fireproofing purposes, the cross-bracing 108 may be hidden inside sheetrock wall, or may be provided instead by a solid concrete wall (rather than the elongated steel girders of FIG. 9). In certain constructions, a door 115 may be provided below or integral with the cross-bracing 108.

When retrofitting concrete walls or columns similar to FIG. 2, and as discussed elsewhere herein, a preferred construction technique includes drilling adjacent cores ("coring"). In walls, this method can be utilized to form an intermittent line of slots in which joint bearing assemblies 10 can then be installed and then pressurized. After such pressurization, the remaining portions of the wall in the "intermittent line" are removed, to complete the "cutting loose" of the wall superstructure from the wall substructure. At these latter locations where no joint bearing assembly 10 is positioned, continuous side plates 32 are epoxied to the wall and anchored with bolts 33 so that the plates 32 are well-bonded to the wall. These plates thereby act as reinforcement for the wall, enabling it to span between adjacent joint bearing assemblies 10 without cracking, by providing horizontal steel reinforcement at those locations not directly supported by the joint bearing assemblies 10.

A wide variety of configurations may be employed to provide the benefits of the invention. In the alternative embodiment of FIGS. 3 and 4, an upper assembly consisting of a concave or spherically-dished plate 90 with a plurality of compressible rubber members 92 and sliding means 94 affixed thereto is positioned appropriately below the upper portion 96 of a column. This concave plate 90 is an alternative construction of the plate means 30 of the preferred embodiment. The compressible rubber members 92 may be affixed to the plate 90 by cleats 93, or by epoxy, vulcanizing, or similar expedient, and are similar in material and function to those of the thin compressible layer 34 of FIG. 2, but are provided in a segmented configuration (in contrast to the contiguous embodiment 34 of FIG. 2). Similarly, the sliding means 94 such as the above-described Teflon®-coated substrates is segmented, providing a reduction in the cost of materials for the joint and a sliding interface which readily conforms to the confronting slidingly mating surface 84, more thoroughly described below, and are similar in material and function to those of members 24 and 26 of FIG. 2.

For ready manufacture and assembly, the rubber members 92 are affixed to steel plate members 95, and the sliding means 94 is fabricated as steel plate members 97 mechanically bonded or pressed into a layer 99 of Teflon ®, similar to that described above. The steel plate members 95 and 97 are then preferably affixed to one another in pairs, such as by tack-welding or the like, to provide the assembly illustrated in FIG. 4.

In the preferred embodiment, the rubber members 92 and their steel backing plates 95 are of a similar size and shape, such as a rectangular shape or the circular shape shown in FIG. 3. Similarly, the Teflon ® 99 and its steel backing 97 are of a similar size and shape, such as a circular shape or the square shape shown in FIG. 3. The sliding means assembly 94 of Teflon ® 99 and steel substrate backing members 97 may, of course, include holes or cavities in the substrate 97 similar to holes 72 (described above) to permit the direct adjustment and calibration of the horizontal frictional force exerted by the sliding means 94.

The plate 90 is preferably slightly concave or spherical, to eliminate the need for levelling it as precisely as is necessary with a horizontally-planar plate, such as plate member 22. The specific slope of the concavity can be calculated so that it is steep enough to make it tolerant of misalignment during field installation, but not so steep as to provide a significant inverted pendulum effect (this inverted pendulum effect is discussed, for example, in U.S. Pat. No. 4,644,714 to Victor A. Zayas). Among other things, the spherical configuration is preferably of a long (as opposed to a tight) radius, and is sloped to lessen the risk that misalignment in the field would have detrimental performance effects due to gravity. In other words, the spherical shape helps prevent the joint from ever sloping "downhill" during the displacement caused by an earthquake, despite an inadvertent amount of misalignment or sloping of the overall joint assembly 10.

An appropriate spherical shape of long radius can be achieved for the plate 90 by a wide variety of methods, such as by cold or hot pressing the plate 90 against a contoured head without expensive machining. In such a forming operation, a sacrificial plate is placed between the plate 90 and the contoured head, so as not to mar the finished surface of the plate 90.

The plates 82 and 90 preferably include studs, welds or cleats 98 formed on or affixed to the side or sides of the joint that is to be grouted. These cleats 98 are useful after the plate assembly 90 is appropriately positioned, at which time grout 100 and 106 is placed behind the plates 82 and 90. The cleats 98 provide a more certain mechanical bond between the plates 82 and 90 and the grout 100 and 106, respectively. To achieve the desired positioning of the plate 82, shims (not shown) may be inserted between the plate 82 and the column 102 prior to grouting.

Also prior to such grouting, and even prior to the aforementioned positioning of the plate assembly 90, a concave bottom plate 82 is inserted above the footing or substructure 78 and 102. For purposes of illustration, the substructure is shown as including a continuous footing 102 and a short height of column or wall 78 remaining after a saw or core drill has been utilized to severe the superstructure from the substructure, as discussed elsewhere herein. The bottom plate 82 is shaped to provide slidingly mating engagement with the concave plate assembly 90, and is fabricated of polished stainless steel, nickel-hardened steel, and/or has a stainless steel veneer 84 to enhance the sliding function. Installation adjustment means 36 such as flat-jacks 76 are affixed to the other side of bottom plate 82 through the use of epoxy mortar 85, metal shims (not shown) or the like, and are preferably positioned in alignment with the sliding means 94. The aforementioned shims may be utilized to roughly level the top of the bottom plate 82 and remove any gaps in the assembly. The upper grouting is then preferably placed behind the plate 90, as described above, and the flat-jacks 76 can then be pressurized until all weight is transferred through them and the assembly is made as close to level as possible by pressurizing one or another of the jacks against the soft rubber spring 92 (described in more detail elsewhere herein).

After the assembly is so positioned, the aforementioned hardening slurry mixture can be pumped into the flat-jacks 76, and the grouting 106 operably placed therearound. Grout 106 need not be placed up to the edge of plate 82. If it is desired to reduce the maximum eccentricity on the shorter portions of the column or wall, it is acceptable to permit some (but not all) parts of the teflon pads 94 to slide past the edge of the grout during maximum displacement. Such an arrangement maintains the necessary contact between the superstructure and substructure, but limits the eccentricity imposed on the column or wall because all vertical loading during maximum displacement will occur through those parts of the teflon pads 94 which are still in contact with that portion of the steel plate 82 that is still in contact with the grout 106.

As indicated above, the edges of the plate 82, 84 preferably have a smooth, long-radius finished curve, so that the confronting teflon-coated surface or other sliding means will not be damaged by a sharp edge if the displacement is greater than anticipated (or if parts of the teflon pads 94 slide past the edge of the plate/grout during maximum displacement).

As indicated above, the provision of installation adjustment means 36 such as the thin layer 92 of compressible rubber and the flat-jacks 76 enables ready field adjustment for vertically positioning the bottom plate 82. By installing a plurality of flat-jacks beneath the bottom plate, vertical adjustment can readily be made before grouting by pressurizing any one of the flat-jacks and compressing the rubber 92 immediately above it. Where a plurality of flat-jacks are utilized, the individual flat-jacks may be selectively pressurized in relation to one another, thereby permitting additional vertical adjustability for levelling the surface 84 of the plate 82.

In addition to the foregoing, the rubber members 92 may be selected to adjust the initial horizontal "stiffness" of the structural system, because the members 92 can act as an additional horizontal spring in the structure. Once sliding begins, the rubber springs also provide the ability for the joint 10 to "rotate" about a vertical axis, in case an earthquake imposes such rotary motion on the building. Such rotation or other unaccounted-for conditions can be absorbed by the rubber spring members.

When ball bearings are utilized as the sliding means, the concavity of the bottom plate can be controlled by the spacing of shims and the compressibility of the rubber layer, such as layer 92. In such a configuration, the sliding means and the rubber layer would preferably be continuous as shown in FIG. 2, instead of segmented as in FIG. 4, so that bearing plates will be in direct compression and not flexure.

FIG. 7 illustrates the application of my invention at the upper end of a column or wall 120. As shown, the operative components are simply inverted from those of FIG. 4, such as flat-jacks 122, grout 123, sliding means 124, and rubber layer 126. In addition, the embodiment of FIG. 7 includes biasing means 128 such as rubber springs or the like operatively affixed between the superstructure 129 and brackets 130 affixed to the column or wall 120.

As indicated above, the rubber pads or layers 126 provide numerous benefits, including, for example, that they: accommodate some degree of misalignment during installation and subsequent displacement; provide a shock buffer so that shuddering of the superstructure is reduced or eliminated even when an earthquake suddenly exerts a force in the direction reverse to that in which the superstructure is sliding; and provide some accommodation of rotational motion between the superstructure and substructure during an earthquake.

As will be understood by those skilled in the art, the sliding performance of the Teflon ®-surfaced members, and the overall sliding performance of the system, may be calculated and designed through the use, among other things, of charts such as the chart of FIG. 10. As shown therein, for a given compressive pressure and a given selection of confronting materials (such as stainless steel and teflon), the coefficient of friction increases initially in response to increasing relative velocity of the superstructure and substructure, but thereafter levels off. As explained elsewhere herein, this means that the amount of horizontal accelerating force imposed on the building's superstructure is limited by the system, at least within the physical sliding area permitted by the configuration of the system 10. Such charts may be prepared for any materials having such a known, calibratible frictional relationship.

Of course, if an earthquake occurred which exceeded the predicted credible earthquake level and the associated safety factor, the system 10 might be subjected to displacement outside of that physical sliding area, thereby causing non-sliding physical interference between the superstructure and the substructure and a corresponding direct transfer of forces through, for example, the limit-stop springs 114 in FIG. 9.

In addition to the foregoing description, a preferred method of installation of the invention into, or retrofit of, existing structures will now be described in greater detail. The preferred method includes the step of pretesting the vertical loads on the columns and/or walls, whereby that actual load information may be utilized instead of mere calculated loads in connection with designing the system. This pretesting may be accomplished, for example, by temporarily supporting the vertical load imposed on a column with a jacking framework or other support means, and measuring the vertical load on such support means. The temporary supports can include piston-jacks for loading the supports in a vertical direction. When such piston-jacks are utilized and are sufficiently extended, tension cracks will appear on the building structure (such as the column being retrofitted), indicating that the support structure is bearing the vertical load at that location, rather than the column.

After the columns have been cut and the vertical load has been determined at all desired locations, that actual load information may be utilized to design or redesign the sliding apparatus of the system (for example, the substrates 27 and 97, including the materials, size, recess configuration, etc. thereof), as described elsewhere herein. Among other things, the use of actual load data improves the accuracy of the design of the system, in that the calculations of sliding forces, etc. will correspondingly increase in accuracy over calculations based on estimated vertical loads.

After the design and fabrication of the sliding apparatus, the preferred method further includes the step of again temporarily supporting the vertical load imposed on a column with a framework or other support means. After the vertical load has been removed from the column, an approximately horizontal section of the column is removed by coring, cutting or other appropriate means. If a cutting saw is utilized to remove the section, the cut surfaces are preferably roughened (such as by etching with acid) or coated with epoxy bonding material, so that the grout will more readily adhere to the cut surfaces. As described elsewhere herein, coring inherently provides cusps that mechanically lock with the grout.

Further in this regard, installation in existing walls is preferably accomplished by a coring method which eliminates the need for a temporary supporting framework. In the method, a series of intermittent slots are drilled horizontally in the wall, and the various sliding apparatus are horizontally positioned in the slots at the desired installation height. The slots are large enough to receive the sliding apparatus assemblies, and the portions of the walls between the slots are sufficiently large to support the vertical load until the sliding apparatus assemblies are installed. After installation of the sliding apparatus assemblies and pressurization with flat-jacks, the portions of the walls between the slots are removed by cutting or coring.

As indicated, the above-described sliding apparatus, including sliding means, was inserted into the vacant horizontal slot of the wall. As explained above, this apparatus permits horizontal movement of the substructure relative to the superstructure.

The ease of installation and adjustment of the sliding apparatus is greatly enhanced by the use of one or more flat-jacks or similarly pressurizable means for adjusting the position and loading of the apparatus relative to the superstructure and/or the substructure. The flat-jacks may be utilized on the upper and/or lower sides of the joint 10. Additionally or alternatively, shims may be positioned above or below the operative assembly of the joint 10, to level the various plates of the joint.

The upper and lower components of the joint are next grouted in place, using cement, epoxy, concrete or other suitable permanent, relatively incompressible material (the grout must bear the vertical load of the column, etc.). If flat-jacks are utilized, they must of course be adjusted prior to such grouting. In the preferred method, one side of the joint does not include flat-jacks, and it is grouted in place first. Subsequently, the flat-jacks on the other side of the joint are pressurized to remove the vertical load from the temporary support and the temporary support is removed. As those skilled in the art will understand, the flat-jacks may also be utilized to adjust the level and/or slope of the sliding components.

The just-described grouting is especially effective in connection with walls, and even columns, that have been "cored" as described above. Such coring is highly desirable because it leaves "cusps" on the top and bottom of the slots. These cusps form ridges that mechanically lock the hardened grout in place. Alternatively, such locking may be accomplished by using acid etching to "roughen" the surface of the slot or surface to which the sliding apparatus is to be grouted.

The preferred method utilizes flat-jacks that are pressurized with water, epoxy mortar, or similar fluid. After the flat-jacks are adjusted to a final position, a slurry or mixture of cement, epoxy mortar, concrete or other suitable material is pumped into the flat-jacks, displacing the water and eventually hardening into a permanent, weightbearing component of the column or wall.

By my invention I provide an improved system for protection of structures against earthquake damage. As set forth herein, the invention achieves a desired controllable sliding between a substructure and a supported superstructure, and does so with a minimum spatial requirement. This is conveniently exemplified by using the "X" nomenclature set forth above. Friction clamp arrangements such as illustrated in FIG. 18 of my U.S. Pat. No. 3,638,377 require an extension of a plate member such as plate 22 which is more than five times X, instead of the twice X dimension set forth above.

Moreover, the sliding characteristics of the system can be carefully matched to the anticipated strength of the earthquake, the weight of the building, the soil conditions on the site, and other factors. This is accomplished by carefully selecting the respective physical characteristics of the sliding means, the biasing means, and the control means of the system.

Moreover, the various components and portions of the present invention may be provided in a variety of sizes, thicknesses, and materials according to the particular application in which they are to be utilized. The system of my invention may also be used in combination with numerous prior art devices or configurations to improve the performance of such prior art systems.

The joint or system of my invention has been described with some particularity but the specific designs and constructions disclosed are not to be taken as delimiting of the invention in that various obvious modifications will at once make themselves apparent to those of ordinary skill in the art, all of which will not depart from the essence of the invention and all such changes and modifications are intended to be encompassed within the appended claims.

I claim:

1. In a system for isolating a superstructure from its substructure to prevent damage to the superstructure from horizontal seismically induced inertial forces acting between the superstructure and the substructure, wherein a plurality of columns and/or walls support the superstructure above the substructure and each of the columns and/or walls is respectively detached from the substructure in an approximately horizontal plane thereby defining the superstructure above the locus of such detachment and the substructure below the locus of such detachment, the combination of:

sliding means disposed at the locus of detachment between the superstructure and the substructure, to permit relative horizontal movement therebetween, said sliding means including bearing plate means operably attached to either the superstructure or the substructure and sliding members operably attached to the other;

control means acting in series with sliding means between the superstructure and the substructure, at one or more contact points for each column or wall support, to exert an adjustable and calibratible range of horizontal drag force or opposite braking force, in opposition to any horizontal relative motion due to the relative velocity of the substructure with respect to the superstructure; and biasing means in parallel and not in series with said control means with respect to said superstructure and said substructure, said biasing means acting as very low stiffness horizontal springs in opposition to any horizontal motion due to relative displacement of the substructure with respect to the superstructure, which stiffness is sufficiently high enough to urge the superstructure to near its original position relative to the substructure under the influence of continued shaking motions, while being sufficiently low enough, relative to the total building mass and the calibrated sliding friction force, that it limits or prevents the transmission of significant harmonic resonance from the substructure to the superstructure.

2. The system of claim 1, in which said detachment divides the respective column or wall into a relatively longer section and a relatively shorter section, and said bearing plate means is operably attached to the relatively shorter section.

3. The system of claim 1 in which said bearing plate means is formed in an approximately horizontal plane.

4. The system of claim 1 in which said bearing plate means and said sliding members include corresponding slightly concave and convex portions, respectively therein, which concavity and convexity, respectively, is of a sufficiently long radius in relation to the supported weight that its equivalent spring stiffness is negligible.

5. The system of claim 1 or claim 2 or claim 3 or claim 4, in which said sliding means includes one or more sliding members disposed between said bearing plate means and whichever of the superstructure or the substructure to which the bearing plate is not attached, said one or more sliding members and said bearing plate means defining the interface at which the superstructure slides with respect to the substructure.

6. The system of claim 5, in which said bearing plate means is attached to the substructure, and one or more flat-jacks are disposed between said bearing plate means and the substructure so as to permit adjustment and/or levelling of said bearing plate means during installation and/or assembly of the system.

7. The system of claim 5, in which said control means includes adjustable clamping means attached to either the substructure or the superstructure, and plate means attached to the other of the substructure or the superstructure and operatively disposed so that said plate means is frictionally engaged with said clamping means, whereby the adjustment of said clamping means affects the horizontal drag force.

8. The system of claim 5, in which said one or more sliding members includes a disposition or layer of adjustable and calibratible friction material in contact with said bearing plate means.

9. The system of claim 1 or claim 2 or claim 3 or claim 4, in which said control means includes substrate means having a coating or disposition of low-friction material affixed to a surface thereof, said low-friction material being in a confronting relationship with said bearing plate means and thereby constituting part of said sliding means.

10. The system of claim 9, in which said substrate means or a metal grid attached thereto includes one or more depressions or openings therein, whereby the selection of the size and/or the number of said depressions or openings determines the remaining cross-sectional area of the low-friction material upon which the vertical force loads of the respective columns and/or walls are imposed, and correspondingly permits adjustment of the bearing pressure that controls calibration of the drag force characteristics of the system during displacement.

11. The system of claim 9, further including shear spring means disposed in series between said superstructure and substructure, whereby some of the impact due to reversal of the horizontal earthquake force, from a drag force to a braking force and vice-versa, is absorbed by displacement of said shear spring means.

12. The system of claim 9, in which said biasing means includes biasing spring members operatively attached in parallel between the superstructure and the substructure.

13. The system of claim 12, in which said spring members are substantially cylindrical with a longitudinal central axis of said cylinder aligned in a substantially vertical or horizontal direction.

14. The system of claim 13, further including programmable restraint means and limitation means to gradually increase the stiffness of the biasing means in correspondence with increasing relative displacement of the substructure with respect to the superstructure, in which said restraint means and limitation means includes one or more substantially inflexible annular members, each of said annular members being disposed about an end of one of said spring members, each of said annular members further having a central annular axis substantially aligned with said central axis of said spring member and having a curvilinear annular cross-section described by the internal diameter of said annular member gradually increasing with the distance along said central annular axis from said end of said spring member.

15. The system of claim 9, further including programmable restraint means and limitation means to gradually increase the stiffness of the biasing means in correspondence with increasing relative displacement of the substructure with respect to the superstructure.

16. The system of claim 15, in which said restraint means and limitation means includes a limit-stop spring.

17. The system of claim 15, in which said restraint means and limitations means comprises a biasing spring that also functions as part of said limitation means.

18. The system of claim 9, further including installation adjustment means to permit ready alignment and selective vertical loading of said control means.

19. The system of claim 18, in which said installation adjustment means includes pressurizable flat-jacks and/or compressible rubber members in vertical load-bearing alignment with said sliding means, the superstructure, and the substructure.

20. The system of claim 9, in which said sliding means includes an array of ball bearings and/or roller bearings.

21. The system of claim 9, in which a control plate member is operatively attached to said superstructure or said substructure adjacent said locus of detachment, and said control means includes one or more adjustable and calibrated clamp members frictionally engaging said plate member at a location or locations on said plate member whereby said plate member may move horizontally in any direction with respect to said clamp member a distance slightly greater than the distance that the superstructure is calculated to move horizontally during the maximum credible earthquake anticipated.

22. In a system for isolating a superstructure from its substructure to prevent damage to the superstructure from horizontal forces acting between the superstructure and the substructure, wherein a plurality of columns and/or walls support the superstructure above the substructure and each of the columns and/or walls is respectively detached from the substructure in an approximately horizontal plane thereby defining the superstructure above the locus of such detachment and the substructure below the locus of such detachment, the combination of:

sliding means disposed at the locus of detachment to permit relative horizontal movement between the superstructure and the substructure;

adjustable and calibratible control means acting between the superstructure and the substructure, said control means including plate means adjacent the locus of the detachment and operably attached to either the superstructure or the substructure, said plate means extending a predetermined distance in an approximately horizontal peripheral direction from the respective column and/or wall, said control means further including means for adjusting and calibrating a horizontal friction drag force in opposition to any relative velocity between the superstructure and the substructure; and biasing means in parallel and not in series with said control means with respect to said superstructure and said substructure, said biasing means acting as very low stiffness horizontal springs in opposition to any horizontal motion due to relative displacement of the substructure with respect to the superstructure, which stiffness is sufficiently high enough to urge the superstructure to near its original position relative to the substructure under the influence of continued shaking motions, while being sufficiently low enough, relative to the total building mass and the calibrated sliding friction force, that it limits or prevents the transmission of significant harmonic resonance from the substructure to the superstructure.

23. The system of claim 22, in which said sliding means includes an array of ball bearings and/or roller bearings.

24. The system of claim 22, in which said control means includes one or more adjustable and calibrated clamp members frictionally engaging said plate means at a location or locations on said plate means whereby said plate means may move horizontally in any direction with respect to said clamp members a distance slightly greater than the distance that the superstructure is calculated to move horizontally during the maximum credible earthquake anticipated.

25. In an apparatus for providing controlled horizontal movement of a superstructure with respect to its substructure during an earthquake at a joint or interface therebetween, the combination of:

control means including plate means disposed approximately horizontally through the joint or interface and operably attached to either the superstructure or the substructure, said plate means extending a predetermined distance in an approximately horizontal peripheral direction from the superstructure or the substructure;

sliding means disposed between said plate means and the other of the superstructure or the substructure, said sliding means being calibratible to permit controlled relative horizontal movement between the superstructure and the substructure when horizontal forces are imposed on the substructure, such as those which accompany an earthquake; and biasing means acting between said plate means and whichever of the superstructure or the substructure to which said plate means is not attached, whereby said biasing means urges the superstructure towards its original position relative to the substructure in response to any such relative movement between the superstructure and the substructure.

26. The apparatus of claim 25, further including installation adjustment means to permit ready alignment and selective vertical loading of said apparatus.

27. The apparatus of claim 26, in which said installation adjustment means includes pressurizable flat-jacks and/or compressible rubber members in vertical load-bearing alignment with said sliding means, the superstructure, and the substructure.

28. In a joint between a portion of a superstructure and a substructure supporting that portion, which joint includes sliding means to permit relative horizontal motion between the superstructure and substructure upon application of sufficient horizontal force;

biasing means in parallel and not in series with said sliding means with respect to said superstructure and said substructure, said biasing means acting as very low stiffness horizontal springs in opposition to any horizontal motion due to relative displacement of the substructure with respect to the superstructure, which stiffness is sufficiently high enough to urge the superstructure to near its original position relative to the substructure under the influence of continued shaking motions, while being sufficiently low enough, relative to the total building mass and the calibrated sliding friction force, that it limits or prevents the transmission of significant harmonic resonance from the substructure to the superstructure; and restraint means and limitation means associated with said biasing means to gradually increase and eventually maximize the biasing force of said biasing means, after a limit of displacement has been reached, in higher proportion to the further displacement of the superstructure relative to the substructure.

29. In a joint between a portion of a superstructure and a substructure supporting that portion, the combination of:

sliding means disposed between the superstructure and the substructure to permit relative horizontal movement between the superstructure and the substructure when horizontal forces are imposed on the substructure, such as those inertial forces which accompany an earthquake;

control means including substrate means by which the area upon which the vertical weight of the superstructure are imposed upon the substructure may be selectively adjusted to a calibrated pressure, by the provision of one or more openings or cavities in said substrate means; and biasing means in parallel and not in series with said control means with respect to said superstructure and said substructure, said biasing means acting as very low stiffness horizontal springs in opposition to any horizontal motion due to relative displacement of the substructure with respect to the superstructure, which stiffness is sufficiently high enough to urge the superstructure to near its original position relative to the substructure under the influence of continued shaking motions, while being sufficiently low enough, relative to the total building mass and the calibrated sliding friction force, that it limits or prevents the transmission of significant harmonic resonance from the substructure to the superstructure.

* * * * *

UNITED STATES PATENT AND TRADEMARK OFFICE

CERTIFICATE OF CORRECTION

PATENT NO. : 5,303,524
DATED : April 19, 1994
INVENTOR(S) : Marc S. Caspe

It is certified that error appears in the above-indentified patent and that said Letters Patent is hereby corrected as shown below:

On the title page, item[54] and Column 1, line 1, "Earthquaker" should read --Earthquake.--

Signed and Sealed this

Sixteenth Day of January, 1996

*Attest:*

*Attesting Officer*

BRUCE LEHMAN

*Commissioner of Patents and Trademarks*